United States Patent [19]

Raudat

[11] 4,207,722

[45] Jun. 17, 1980

[54] FINGER ASSEMBLY FOR CASE LOADER

[75] Inventor: John L. Raudat, North Madison, Conn.

[73] Assignee: Standard-Knapp, Inc., Portland, Conn.

[21] Appl. No.: 963,361

[22] Filed: Nov. 24, 1978

[51] Int. Cl.[2] ..... B65B 21/16

[52] U.S. Cl. ..... 53/248; 53/262

[58] Field of Search ..... 53/248, 260, 261, 262

[56] References Cited

U.S. PATENT DOCUMENTS

| | | | |
|---|---|---|---|
| 4,033,095 | 7/1977 | Wild | 53/248 |
| 4,035,986 | 7/1977 | Clem et al. | 53/248 X |

*Primary Examiner*—Travis S. McGehee

*Attorney, Agent, or Firm*—McCormick, Paulding & Huber

[57] ABSTRACT

A finger assembly includes a finger holder supported in depending position on a horizontal rail for adjustable positioning therealong. Flexible fingers extend downwardly and outwardly from the holder and are clamped thereto by a retaining member, received within a downwardly opening cavity in the holder, and a single clamping screw, secured to and extending upwardly through the retaining member and engaging the holder. The fingers are releasably retained in depending position on the retaining member so that the fingers, the retaining member, and the clamping screw may be inserted into and removed from the holder as a unit. The clamping screw is accessible from and a position below the assembly.

11 Claims, 4 Drawing Figures

FINGER ASSEMBLY FOR CASE LOADER

BACKGROUND OF THE INVENTION

This invention relates in general to case loading machines of the type which include a grid assembly and deals more particularly with an improved finger assembly for such a machine.

A machine of the aforedescribed type is generally used to pack articles of uniform size and shape as for example, bottles, cans and the like in cases or containers which may be provided with compartments or cells for holding individual articles. A charge of articles to be loaded is accumulated in a grid frame, which comprises a part of the grid assembly, and discharged through it into a carton or case. Finger assemblies of the type with which the present invention is concerned, and which also comprise a part of the grid assembly, are usually supported below the grid frame and serve to control the gravity fall of the charge as it drops from the frame into a case. Both the grid frame and the various finger assemblies associated with it must be adjustable in both longitudinal and transverse directions to accommodate articles of varying size and to vary packing patterns.

Since the flexible fingers which comprise the finger assemblies may become damaged or broken by being repeatedly struck by falling charges and cases moving into and out of loading position, it is desirable that these flexible fingers be readily replaceable to minimize machine down time when damage or breakage does occur. Heretofore various finger assemblies have been provided wherein individual fingers may be released and removed from assembly from a position above the grid frame. However, the arrangement of the grid frame in some case loading machines is such that access to the finger assemblies from above may be difficult. Accordingly, it is the general aim of the present invention to provide an improved finger assembly for adjustable mounting on a case loader and which facilitates removal of an individual finger or group of fingers comprising an assembly from a position below the assembly.

SUMMARY OF THE INVENTION

In accordance with the present invention an improved finger assembly for a case loader is provided which includes a finger holder, means for adjustably mounting the finger holder in depending position on a part of a case loader and at least one flexible finger which extends downwardly and outwardly from the finger holder. The one finger is releasably retained in assembly with the holder by opposing clamping surfaces on the finger holder and on a finger retaining member which engage an upper portion of the finger. A single clamping fastener extends upwardly through the retaining member and engages a lower portion of the finger holder to releasably retain the upper portion of the finger between opposing clamping surfaces on the finger holder and the finger retaining member.

DETAILED DESCRIPTION OF PREFERRED EMBODIMENT

Figure 1:
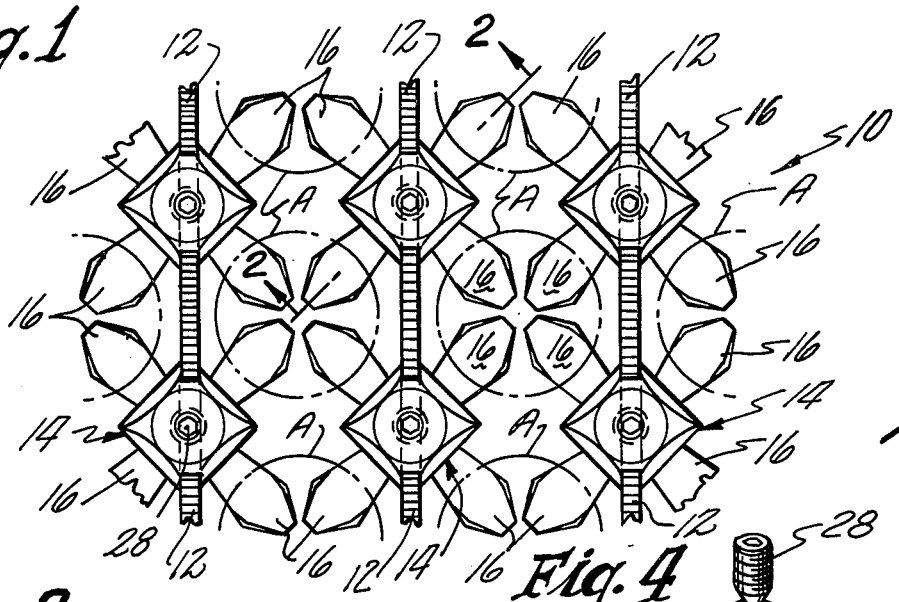
FIG. 1 is a fragmentary plan view of a portion of a case loader having finger assemblies embodying the present invention.

Turning now to the drawing a portion of a case loading machine embodying the present invention is shown in FIG. 1 and indicated generally by the reference numeral 10. The machine 10 has a grid assembly which includes a grid frame (not shown) and a plurality of parallel mounting rails 12, 12 which may be supported below the grid frame and which usually extend horizontally and in the direction of article flow. The rails are usually supported on the machine for adjustment so that the spacing between adjacent rails may be varied to accommodate articles of varying widths which must pass downwardly therebetween. As illustrated, each rail carries a longitudinally spaced series of corner finger assemblies, indicated generally at 14, 14, which embody the present invention. The finger assemblies 14, 14 are supported for adjustable positioning along the rails 12, 12 whereby the longitudinal spacing between adjacent finger assemblies 14, 14 in the series may be varied to accommodate articles of various sizes, as will be hereinafter further discussed. In accordance with the present invention, each finger assembly includes at least one flexible finger, however, the number of fingers in an assembly may vary and in some instances will be determined by the position of the assembly within an array of finger assemblies for controlling an article charge. However, each of the finger assemblies 14 in the array shown in FIG. 1 has four depending resilient flexible fingers indicated at 16, 16. The fingers 16, 16 of adjacent assemblies 14, 14 cooperate to define article directing channels for controlling the gravity fall of articles, such as indicated at A, A in FIG. 1. A typical grid assembly is shown in U.S. Pat. No. 3,561,189 to Raudat, assigned to the assignee of the present application, and herein adapted by reference in its entirety. Reference may be had to the aforesaid patent for further disclosure of a grid assembly.

Figure 2:
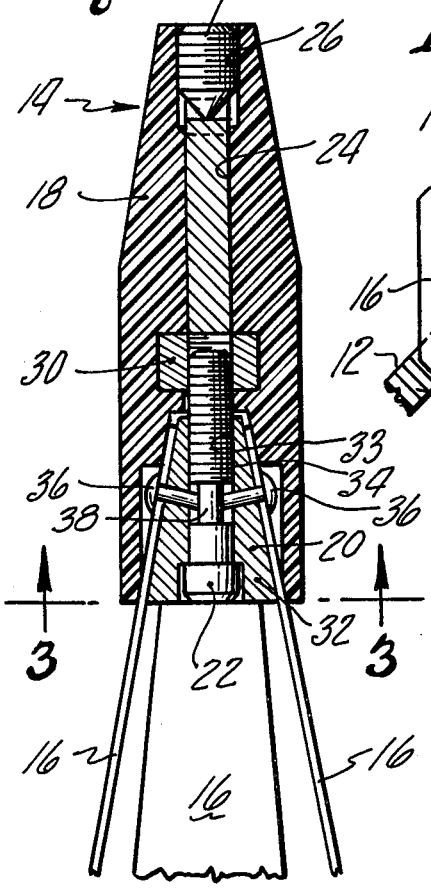
FIG. 2 is somewhat enlarged fragmentary vertical sectional view through a typical finger assembly and taken along the line 202 of FIG. 1.
Figure 3:
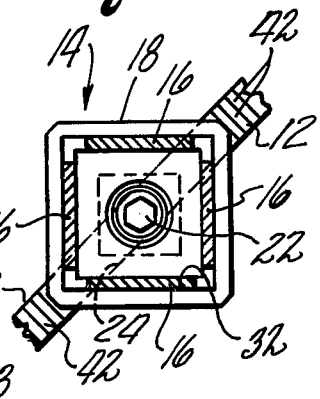
FIG. 3 is a sectional view taken generally along the line 33 of FIG. 2.
Figure 4:
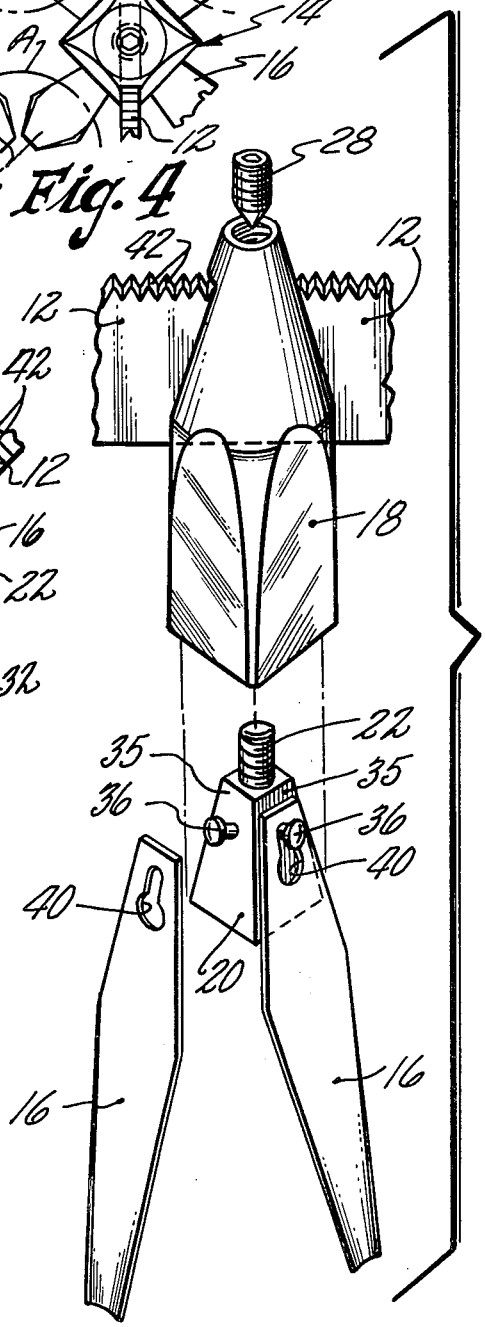
FIG. 4 is an exploded perspective view of the finger assembly shown in relation to a part of a case loader.

Referring now to FIGS. 2–4, a typical corner finger assembly 14 includes a finger holder 18, a finger retaining member 20 and a single fastener or clamping screw 22 which extends upwardly through the retaining member 20 and engages the finger holder 18 to releasably secure each finger 16 in a downwardly and outwardly extending position relative to the finger holder 18, substantially as shown.

Considering now the assembly 14 in further detail, the illustrated finger holder 18 is made from plastic material and has a truncate conical upper part. The lower part of the finger holder has a substantially square cross section and is characterized by parallel opposite side faces which terminate at the square lower end of the holder, as best shown in FIG. 3. A transverse slot 24 extends through the upper part of the holder and in a diagonal direction relative to its square lower end, as best shown in FIG. 3. A threaded opening 26 formed in the upper end of the holder communicates with the slot 24 and receives a cone pointed set screw 28. When the holder 18 is made from plastic, as shown, a metal nut 30 is preferably molded into a central part of the holder immediately below the slot 24, as best shown in FIG. 2. A downwardly opening cavity 32 formed in the lower end of the finger holder is shaped to generally complement the retaining member 20, as will be hereinafter further described. An upwardly extending bore 33 communicates with the cavity 32 and with the threaded portion of the nut 30.

The retaining member 20 preferably comprises a metal block which has the form of a truncate pyramid with four side faces 35, 35. A central bore 34 extends upwardly through the retaining member 20 and has a diametrically enlarged portion at its lower end to provide a shoulder for seating the head of the clamping screw 22 which is received within the bore. The retaining member 20 carries four pins 36, 36. Each pin extends into the retaining member and is generally axially normal to an associated side face 35. Each pin projects for some distance beyond its associated side face and has an enlarged head at its outer end. At least one of the pins 36 projects into the bore 34 and extends into an annular groove 38 formed in the clamping screw 22, as shown in FIG. 2. The later pin 36 serves to retain the clamping screw 22 in assembled relation with the retaining member 20.

The flexible finger 16, 16 may be made from any suitable material such as metal or plastic and may vary in shape. The configuration of the fingers 16, 16 will, of course, be determined, at least to some degree, by the physical characteristics of the articles to be packed. Each finger 16 has an upper end portion with a slot 40 formed therein. The width of the upper portion of the slot is somewhat smaller than the width of the enlarged head on a pin 36. However, the lower portion of the slot is substantially enlarged to permit the head of an associated pin 36 to pass freely therethrough. The pins 36, 36 cooperate with the slots 40, 40 to support the fingers 16, 16 in depending position on the retaining member 20. Thus, the retaining member 20, the clamping screw 22 and the fingers 16, 16 comprise a substantially unitary subassembly when held with the clamping screw 22 in an axially vertical position.

Each finger holder 14 is slidably supported on an associated rail 12, which extends through the slot 24, and may be selectively positioned along the rail and secured in position by tightening the set screw 28. If desired, each rail 14 may be provided with a longitudinal series of generally V-shaped locking notches, such as indicated at 42, 42 in FIG. 4, for receiving the cone point on the set screw 28 to facilitate finger assembly positioning.

When it becomes necessary to repair or replace one or more of the fingers 16 which comprise the assembly 14 the clamping screw 22, which is accessible from below, is threaded out of engagement with the nut 30. The retaining member 20, the clamping screw 22, and the fingers 16, 16 comprise a substantially unitary subassembly and may be removed from the cavity 32 as a unit. After removal, each broken or damaged finger 16 which requires repair or replacement may be readily removed from the retaining member 20 by moving the finger upwardly relative to the retaining member to bring the enlarged head on the pin 36 into alignment with the lower releasing portion of the slot 40. After the damaged finger has been repaired or replaced the retaining member with the fingers positioned thereon is inserted upwardly into the cavity and the clamping screw 20 engaged and tightened to restore the assembly to operable condition.

I claim:

1. A finger assembly for a case loader comprising a finger holder, means for adjustably mounting said finger holder in depending position on a part of the loader, a finger retaining member, a single fastener extending upwardly through said retaining member and engaged with a lower portion of said finger holder, said finger holder and said retainin member having opposing clamping surfaces thereon, and at least one flexible finger having an upper portion disposed between and releasably retained by said clamping surfaces, said finger in its clamped position extending downwardly and outwardly from said finger holder.

2. A finger assembly for a case loader as set forth in claim 1 and including finger supporting means for releasably supporting said finger in depending position on said retaining means when said retaining means is separated from said finger holder.

3. A finger assembly for a case leader as set forth in claim 2 wherein finger supporting means comprises a pin projecting outwardly from said retaining means and a slot in said upper portion receiving said pin therethrough.

4. A finger assembly for a case loader as set forth in claim 3 wherein said pin has an enlarged head at its outer end and said slot has an upper portion having a width smaller than the width of said head and a lower portion larger than said head to allow said head to pass therethrough.

5. A finger assembly for a case loader as set forth in claim 1 including means for securing said fastener in assembly with said retaining means when said retaining means is separated from said finger holder.

6. A finger assembly for a case loader as set forth in claim 5 wherein said fastener securing means comprises means for supporting said finger in depending position on said retaining means when said retaining means is separated from said finger holder.

7. A finger assembly for a case loader as set forth in either claim 5 or claim 6 wherein said fastener comprises a threaded fastener having an annular groove therein and said fastener securing means comprises a pin carried by said retaining means and having an end thereof disposed within said annular groove.

8. A finger assembly for a case loader as set forth in any one of claims 1–6 wherein said finger holder has a downwardly opening cavity therein, and said retaining means is received in assembly within said cavity.

9. A finger assembly for a case loader as set forth in claim 8 wherein said retaining member comprises a block having truncate pyramid form and said clamping surfaces are defined by surfaces of said cavity and associated portions of the faces of said block.

10. A finger assembly for a case loader as set forth in claim 1 wherein the case loader part comprises a rail and said mounting means comprises a slot extending transversely through an upper portion of said finger holder and receiving an associated portion of the rail therethrough and a clamping fastener carried by said finger holder and clamping engaging said rail within said slot.

11. A finger assembly for a case loader as set forth in claim 10 wherein said rail has a longitudinally series of notches formed therein and said fastener comprises a cone pointed set screw clampingly engaging said rail within an associated one of said notches.

* * * * *